US009570840B2

(12) United States Patent
Morikawa et al.

(10) Patent No.: US 9,570,840 B2
(45) Date of Patent: Feb. 14, 2017

(54) CORROSION-RESISTANT TERMINAL, WIRE WITH CORROSION-RESISTANT TERMINAL AND METHOD FOR PRODUCING WIRE WITH CORROSION-RESISTANT TERMINAL

(71) Applicant: Sumitomo Wiring Systems, Ltd., Yokkaichi, Mie (JP)

(72) Inventors: Satoshi Morikawa, Mie (JP); Shohei Mitsui, Mie (JP)

(73) Assignee: SUMITOMO WIRING SYSTEMS, LTD. (JP)

( * ) Notice: Subject to any disclaimer, the term of this patent is extended or adjusted under 35 U.S.C. 154(b) by 0 days.

(21) Appl. No.: 14/770,157

(22) PCT Filed: Mar. 12, 2014

(86) PCT No.: PCT/JP2014/056443
§ 371 (c)(1),
(2) Date: Aug. 25, 2015

(87) PCT Pub. No.: WO2014/142155
PCT Pub. Date: Sep. 18, 2014

(65) Prior Publication Data

US 2016/0006168 A1 Jan. 7, 2016

(30) Foreign Application Priority Data

Mar. 15, 2013 (JP) ..... 2013-052971

(51) Int. Cl.
*H01R 4/10* (2006.01)
*H01R 13/533* (2006.01)
(Continued)

(52) U.S. Cl.
CPC ..... *H01R 13/533* (2013.01); *H01R 4/18* (2013.01); *H01R 4/62* (2013.01); *H01R 4/70* (2013.01);
(Continued)

(58) Field of Classification Search
CPC ..... H01R 4/70; H01R 43/16; H01R 4/18; H01R 43/048; H01R 4/62; H01R 4/185; H01R 13/533; H01R 4/188
(Continued)

(56) References Cited

U.S. PATENT DOCUMENTS

2012/0329341 A1 12/2012 Morikawa et al.

FOREIGN PATENT DOCUMENTS

JP 2010-165514 7/2010
JP 2011-018489 1/2011
(Continued)

OTHER PUBLICATIONS

International Search Report, Jul. 2009.

*Primary Examiner* — Khiem Nguyen
(74) *Attorney, Agent, or Firm* — Gerald E. Hespos; Michael J. Porco; Matthew T. Hespos

(57) ABSTRACT

The present invention concerns a corrosion-resistant terminal (10) before being crimped to an aluminum wire (40) in which a core (41) is covered with a coating (42) and the corrosion-resistant terminal (10) includes a wire barrel (31) to be crimped to the core (41) exposed by removing the coating (42), an insulation barrel (32) to be crimped to the coating (42), and an anticorrosive (50) applied in advance to a surface of the insulation barrel (32) to be held in contact with the coating (40). According to such a configuration, since the anticorrosive (50) is applied in advance to the surface of the insulation barrel (32) to be held in contact with the coating (42) of the aluminum wire (40), the anticorrosive 50 can be filled between the insulation barrel (32) and the coating (42) of the aluminum wire (40) when crimping is performed.

7 Claims, 15 Drawing Sheets

(51) Int. Cl.

| | |
|---|---|
| ***H01R 4/62*** | (2006.01) |
| ***H01R 43/048*** | (2006.01) |
| ***H01R 43/16*** | (2006.01) |
| ***H01R 4/70*** | (2006.01) |
| *H01R 4/18* | (2006.01) |

(52) U.S. Cl.
CPC ..... *H01R 43/048* (2013.01); *H01R 43/16* (2013.01); *H01R 4/185* (2013.01); *H01R 4/188* (2013.01)

(58) Field of Classification Search
USPC ..... 439/524, 741, 877
See application file for complete search history.

(56) References Cited

FOREIGN PATENT DOCUMENTS

| | | |
|---|---|---|
| JP | 2011-192530 | 9/2011 |
| JP | 2011-204582 | 10/2011 |
| JP | 2013-080682 | 5/2013 |
| JP | 2013-235716 | 11/2013 |

CORROSION-RESISTANT TERMINAL, WIRE WITH CORROSION-RESISTANT TERMINAL AND METHOD FOR PRODUCING WIRE WITH CORROSION-RESISTANT TERMINAL

BACKGROUND

1. Field of the Invention

The present invention relates to a corrosion-resistant terminal, a wire with corrosion-resistant terminal and a method for producing a wire with corrosion-resistant terminal.

2. Description of the Related Art

In recent years, aluminum wires have been used for the purpose of weight reduction and the like also in the fields of automotive wiring harnesses and the like. In electrically conductively connecting an aluminum wire to a terminal, electrolytic corrosion in which metals are dissolved in the form of ions in moisture and the corrosion of base metals proceeds by an electrochemical reaction is known to occur if a core of the aluminum wire and the terminal are formed of different types of metals, particularly if moisture is present on a contact part of the both. Here, since the terminal is formed by press-working a copper base material, the electrolytic corrosion of the aluminum wire becomes problematic between copper and aluminum if the aluminum wire is used as a wire as described above.

Accordingly, in a terminal described in Japanese Unexamined Patent Publication No. 2011-192530, electrolytic corrosion is prevented by providing sealing between the inside and outside of an insulation barrel by an anticorrosion treatment using a resin mold or the like. Thus, a groove into which the anticorrosive is introduced is formed on a surface of the insulation barrel to be held in contact with a coating of an aluminum wire and the anticorrosive is filled into the groove by dripping the anticorrosive after crimping.

However, the coating of the aluminum wire may bite into the groove depending on a crimping condition of the insulation barrel and the anticorrosive may not be able to be introduced into the groove. As a result, a clearance is formed between the insulation barrel and the coating of the aluminum wire to permit the penetration of water, wherefore electrolytic corrosion may occur.

The present invention was completed based on the above situation and aims to prevent electrolytic corrosion by reliably providing an anticorrosive between an insulation barrel and a coated wire.

SUMMARY

The present invention is directed to a corrosion-resistant terminal before being crimped to a coated wire in which a core is covered with a coating, including a wire barrel to be crimped to the core exposed by removing the coating, an insulation barrel to be crimped to the coating, and an anticorrosive applied in advance to a surface of the insulation barrel to be held in contact with the coating.

According to such a configuration, since the anticorrosive is applied in advance to the surface of the insulation barrel to be held in contact with the coating of the coated wire, the anticorrosive can be filled between the insulation barrel and the coating of the coated wire when crimping is performed. Thus, electrolytic corrosion can be prevented by reliably providing the anticorrosive between the insulation barrel and the coated wire.

An anticorrosive penetration groove extending in a direction intersecting with an axial direction of the coated wire may be formed on the surface of the insulation barrel to be held in contact with the coating, and the anticorrosive may be filled in the anticorrosive penetration groove in a state where the insulation barrel is crimped to the coating.

According to such a configuration, since the anticorrosive is filled in the anticorrosive penetration groove in the crimped state, the anticorrosive can be reliably provided between the insulation barrel and the coated wire.

The insulation barrel may include a bottom wall and a pair of barrel pieces standing up from opposite side edges of the bottom wall, and the anticorrosive penetration groove may be closed on tip parts of the pair of barrel pieces.

According to such a configuration, the anticorrosive can be applied substantially over the entire circumferential region of the insulation barrel. Further, since the anticorrosive penetration groove is not open on the tip parts of the barrel pieces, there is no possibility that the anticorrosive leaks out from the tips of the barrel as crimping is performed and the anticorrosive can be retained between the insulation barrel and the coated wire.

The anticorrosive may move along the anticorrosive penetration groove and spread in a circumferential direction as crimping to the coated wire is performed.

According to such a configuration, the anticorrosive needs not be applied to the entire surface of the insulation barrel to be held in contact with the coating. Since the anticorrosive spreads in the circumferential direction through the anticorrosive penetration groove when crimping is performed, the anticorrosive can be filled between the insulation barrel and the coating of the coated wire.

Further, the present invention may also be directed to a wire with corrosion-resistant terminal, including the above corrosion-resistant terminal and a coated wire connected to the corrosion-resistant terminal, wherein the anticorrosive is further applied to the crimped insulation barrel after the coating of the coated wire is placed on the insulation barrel to be in contact with the anticorrosive and crimping is performed.

Further, the present invention may be directed to a method for producing a wire with corrosion-resistant terminal, including a pre-crimping applying step of applying an anticorrosive in advance to a crimping surface of an insulation barrel of a corrosion-resistant terminal including a wire barrel and the insulation barrel, a crimping step of placing a coating of a coated wire on the crimping surface of the insulation barrel and performing crimping to fill the anticorrosive between the coating of the coated wire and the insulation barrel, and a post-crimping applying step of further applying the anticorrosive to the crimped insulation barrel.

According to the present invention, it is possible to prevent electrolytic corrosion by reliably providing an anticorrosive between an insulation barrel and a coated wire.

DETAILED DESCRIPTION

Figure 1:
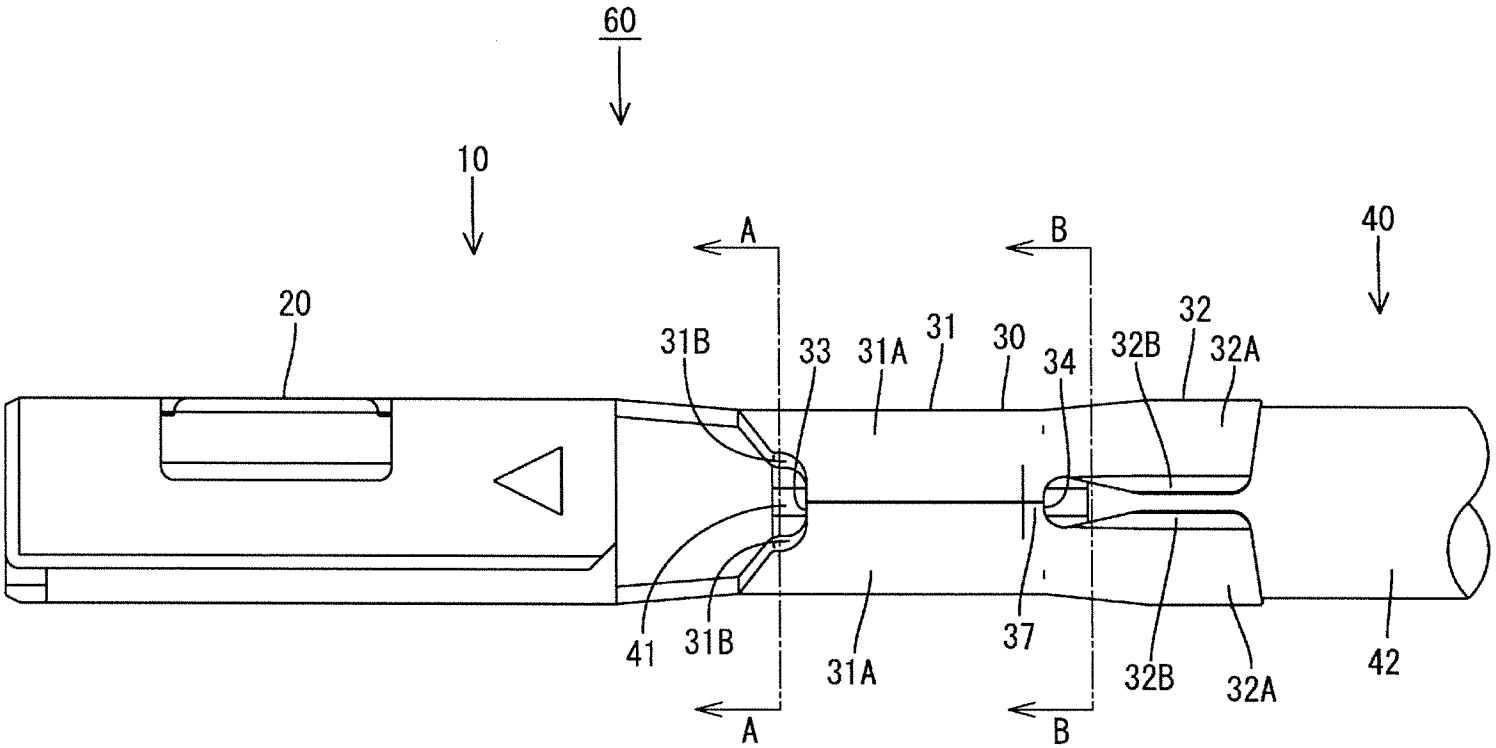
FIG. 1 is a plan view of an aluminum wire with corrosion-resistant terminal.

An embodiment of the present invention is described with reference to FIGS. 1 to 15. A corrosion-resistant terminal 10 in this embodiment includes a terminal connecting portion 20 in the form of a rectangular tube and a wire connecting portion 30 formed behind this terminal connecting portion 20 as shown in FIG. 8. The wire connecting portion 30 is crimped to an end of an aluminum wire 40 as shown in FIG. 1 and an anticorrosive 50 is applied to the wire connecting portion 30 as shown in FIG. 4, whereby an aluminum wire with corrosion-resistant terminal 60 is configured. The anticorrosive 50 is cured by UV irradiation for a predetermined time after being dripped or sprayed in a state of liquid concentrate from above the corrosion-resistant terminal 10.

The corrosion-resistant terminal 10 is formed by punching out a base material made of copper alloy and applying bending and the like to a punched-out piece. As shown in FIG. 8, the terminal connecting portion 20 is formed into a box shape in the form of a rectangular tube and a resilient contact piece 21 is formed in this terminal connecting portion 20. This resilient contact piece 21 extends backward from the front edge of a bottom wall of the terminal connecting portion 20 and is resiliently deformable. When a tab-like male terminal (not shown) is connected to the corrosion-resistant terminal 10, the male terminal is sandwiched between the resilient contact piece 21 and a ceiling wall of the terminal connecting portion 20, whereby the male terminal and the corrosion-resistant terminal 10 are electrically conductively connected.

The wire connecting portion 30 includes a wire barrel 31 to be connected to a core 41 of the aluminum wire 40 and an insulation barrel 32 to be connected to a coating 42 of the aluminum wire 40. Further, the wire connecting portion 30 includes a bottom wall 38 common to the terminal connecting portion 20. The core 41 is formed by twisting a plurality of metal strands made of aluminum. Further, the coating 42 is made of insulating resin. The core 41 is exposed by removing the coating 42 at an end of the aluminum wire 40, the wire barrel 31 is crimped and electrically conductively connected to this core 41 and the insulation barrel 32 is crimped to the coating 42.

The wire barrel 31 includes a pair of wire barrel pieces 31A standing up from opposite side edges of the bottom wall 38 common to the terminal connecting portion 20 and is crimped to the core 41 in such a manner as to bite into the core 41 while rolling these wire barrel pieces 31A inwardly. On the other hand, the insulation barrel 32 includes a pair of insulation barrel pieces 32A standing up from the opposite side edges of the bottom wall 38 common to the terminal connecting portion 20 and is crimped to the coating 42 in such a manner as to extend along the outer peripheral surface of the coating 42 by these insulation barrel pieces 32A. As shown in FIG. 1, the tips of the insulation barrel pieces 32A after crimping are arranged with a predetermined gap formed therebetween without overlapping each other.

Figure 14:
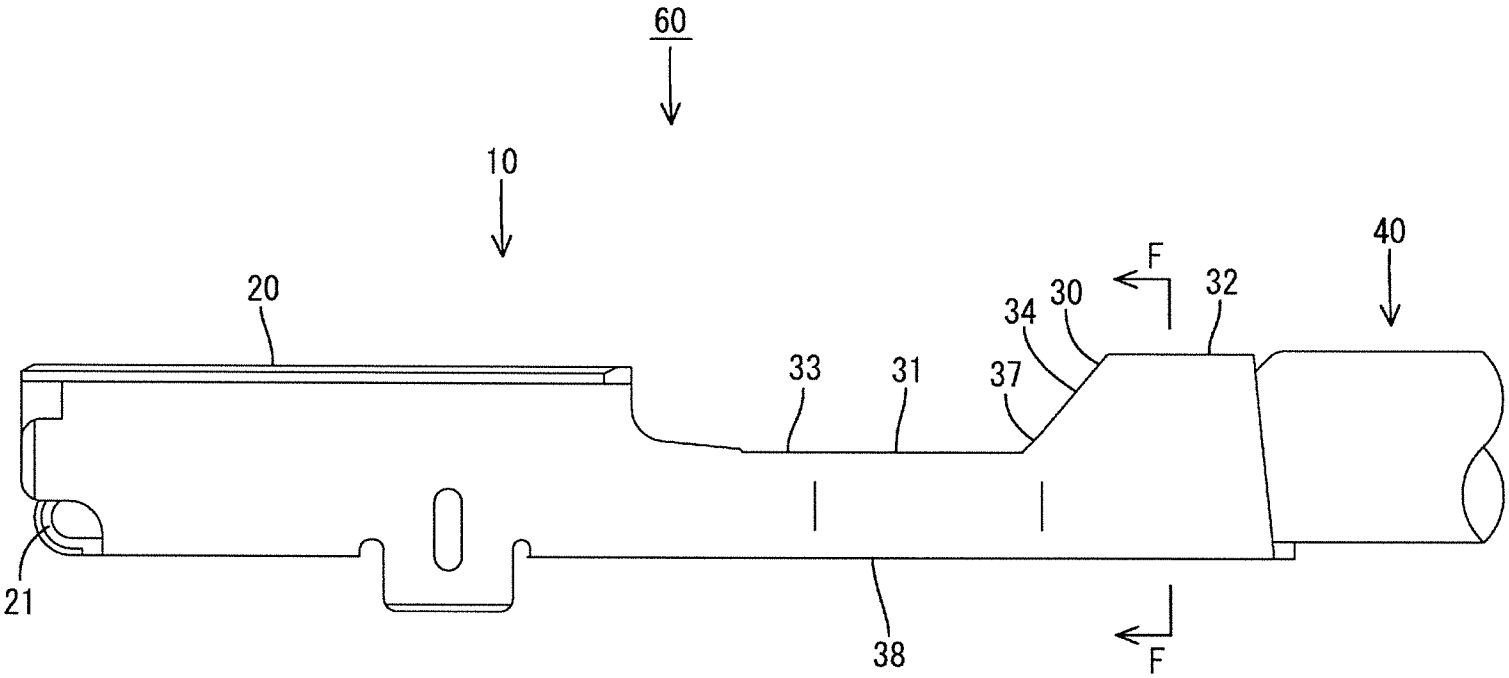
FIG. 14 is a side view of the aluminum wire with corrosion-resistant terminal.

A pair of storage portions 33, 34 are formed on both front and rear sides of the wire barrel 31. Out of these, the storage portion located on the front side is referred to as a front storage portion 33 and the storage portion located on the rear side is referred to as a rear storage portion 34. As shown in FIG. 14, a front end part of the wire barrel 31 is formed with no bell-mouth, a rear end part of the wire barrel 31 is formed with a bell-mouth 37 at the time of crimping, and this bell-mouth 37 has a tapered shape inclined upward toward the back as it extends from the rear end part of the wire barrel 31. Further, the wire barrel 31 and the insulation barrel 32 are seamlessly and continuously formed in a side view and the rear storage portion 34 is formed in this continuous part. Note that, as shown in FIG. 1, the rear storage portion 34 extends directly backward from an end part of the base material exposed on the rear end of the bell-mouth 37.

Figure 2:
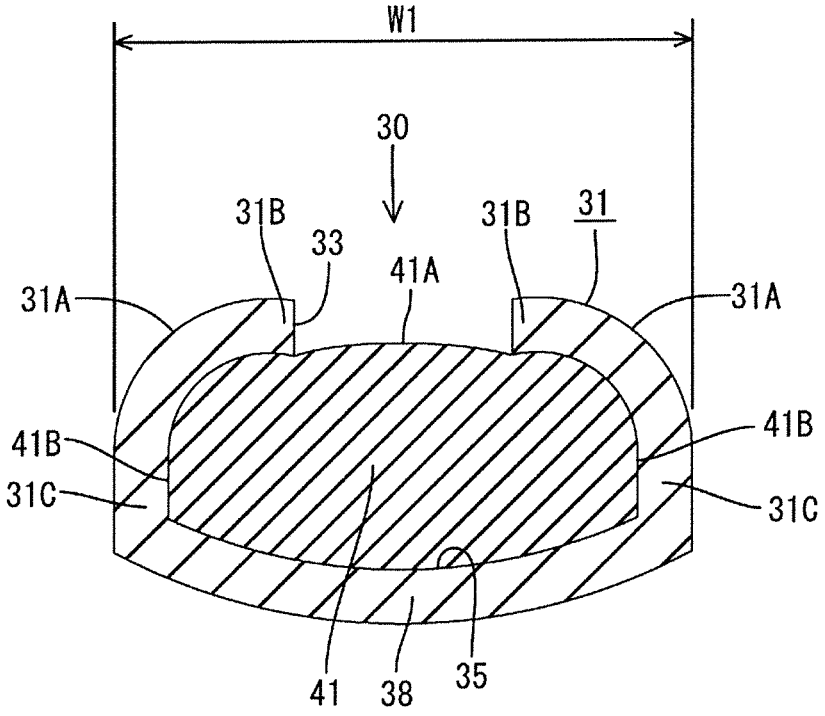
FIG. 2 is a section along A-A of FIG. 1.

As shown in FIG. 2, the front storage portion 33 is in the form of a recess open upward and surrounded by tip parts 31B of the pair of left and right wire barrel pieces 31A and an upper part 41A of the core 41. The respective wire barrel pieces 31A are arranged to be wound around the core 41, the tip parts 31B of the respective wire barrel piece 31A are both arranged to face inward on the upper part 41A of the core 41 and base end parts 31C thereof are both arranged to vertically extend on opposite side parts 41B of the core 41. Further, the tip parts 31B of the respective wire barrel pieces 31A are facing each other in a lateral direction and both arranged substantially perpendicular to the upper part 41A of the core 41.

Figure 5:
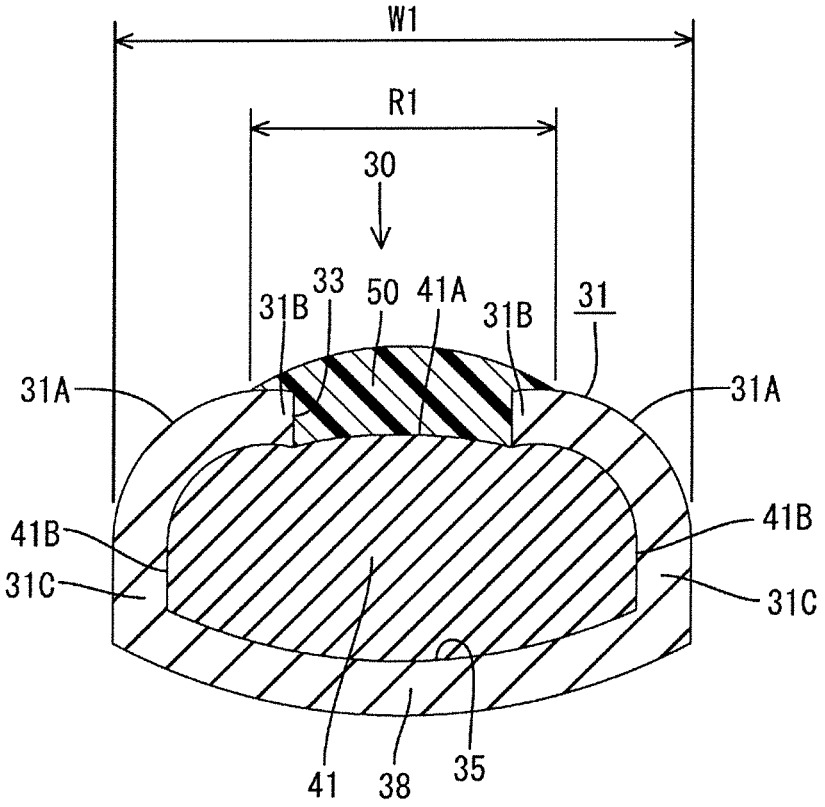
FIG. 5 is a section along C-C of FIG. 4.

Thus, if the anticorrosive 50 is dripped into the front storage portion 33, most of the anticorrosive 50 is stored in the front storage portion 33 and the anticorrosive 50 leaking out from this front storage portion 33 is also stored between the tip parts 31B as shown in FIG. 5, wherefore the anticorrosive 50 does not flow out to the base end parts 31C. Specifically, since the anticorrosive 50 applied to the wire barrel 31 is arranged in a region R1 narrower than a maximum width region W1 on the upper surface of the wire barrel 31, the wire barrel 31 is not enlarged by the anticorrosive 50.

Figure 3:
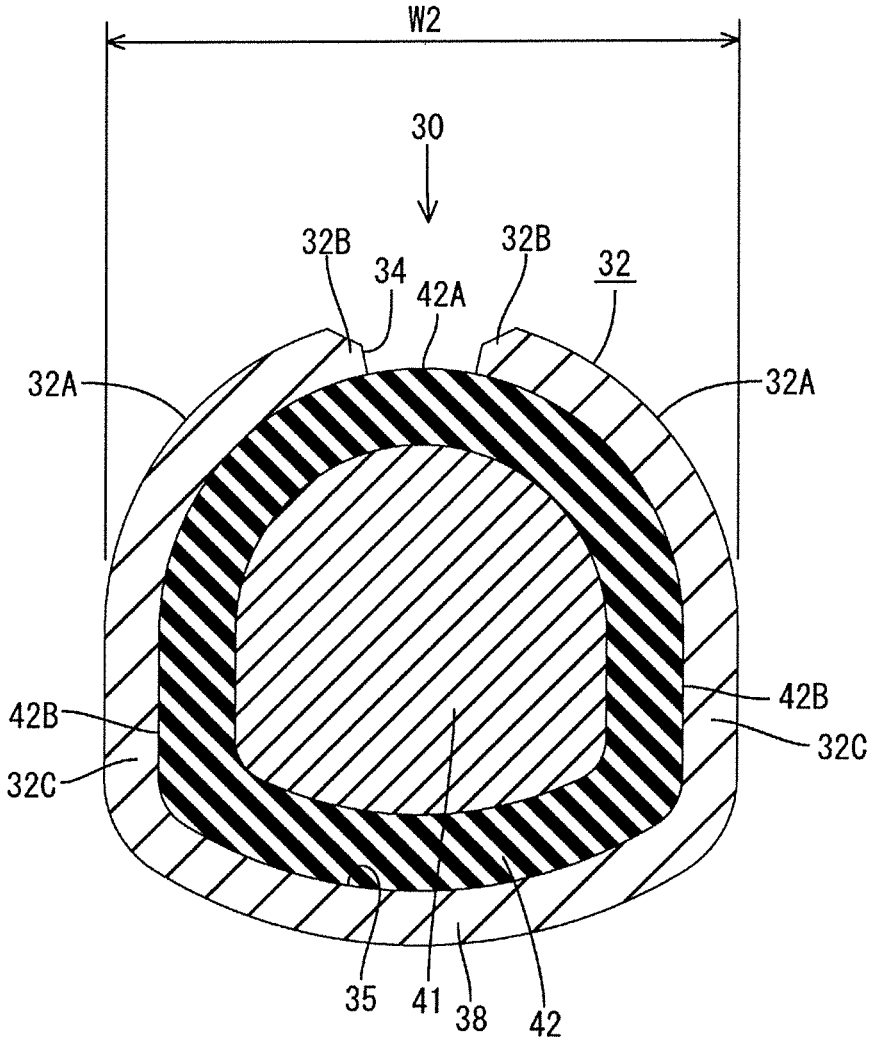
FIG. 3 is a section along B-B of FIG. 1.
Figure 4:
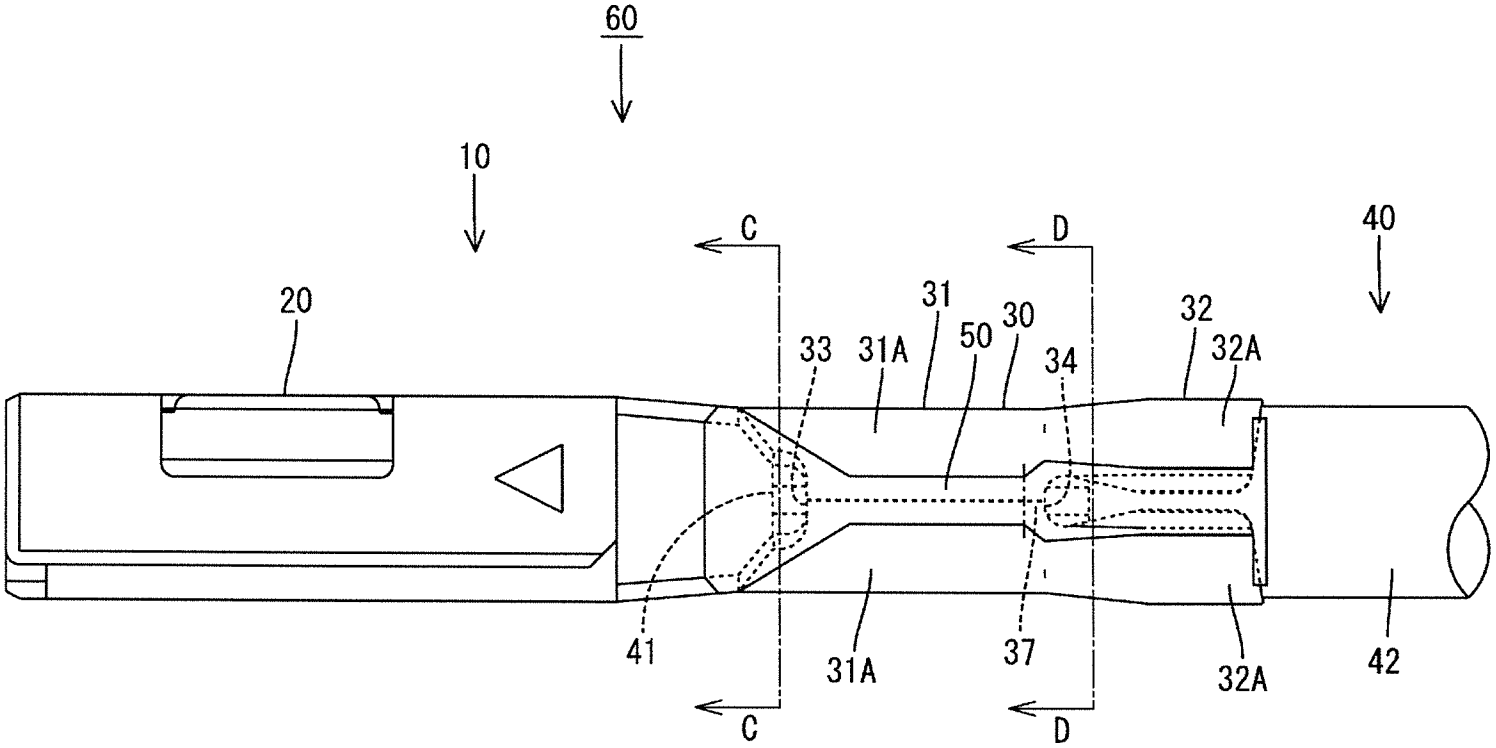
FIG. 4 is a plan view showing a state where an anticorrosion treatment is applied to the aluminum wire with corrosion-resistant terminal.

As shown in FIG. 3, the rear storage portion 34 is in the form of a recess open upward and surrounded by tip parts 32B of the pair of left and right insulation barrel pieces 32A and an upper part 42A of the coating 42. The respective insulation barrel pieces 32A are arranged to be wound around the coating 42, the tip parts 32B of the respective insulation barrel piece 32A are both arranged to face inward on the upper part 42A of the coating 42 and base end parts 32C thereof are both arranged to vertically extend on opposite side parts 42B of the coating 42. Further, the tip parts 32B of the respective insulation barrel pieces 32A are facing each other in the lateral direction and both arranged substantially perpendicular to the upper part 42A of the coating 42.

Figure 6:
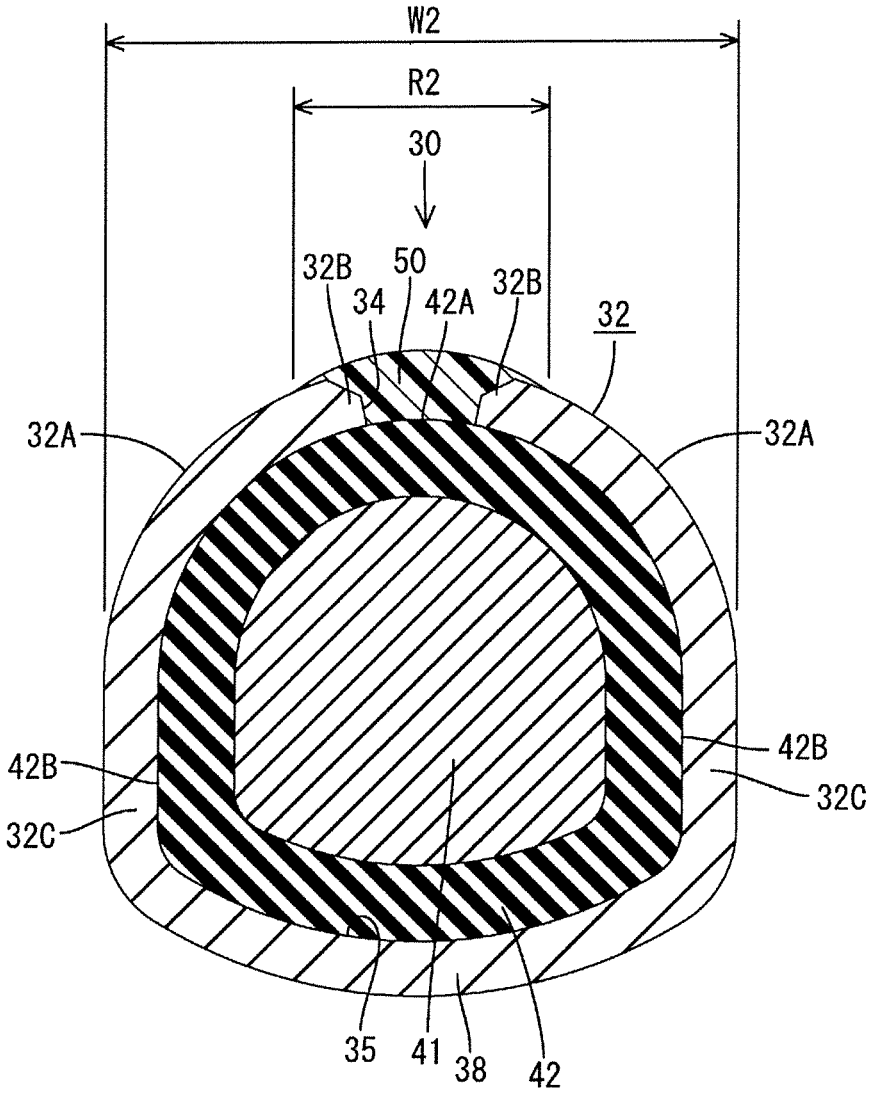
FIG. 6 is a section along D-D of FIG. 4.

Thus, if the anticorrosive 50 is dripped into the rear storage portion 34, most of the anticorrosive 50 is stored in the rear storage portion 34 and the anticorrosive 50 leaking out from this rear storage portion 34 is also stored between the tip parts 32B as shown in FIG. 6, wherefore the anticorrosive 50 does not flow out to the base end parts 32C.

Specifically, since the anticorrosive 50 applied to the insulation barrel 32 is arranged in a region R2 narrower than a maximum width region W2 on the upper surface of the insulation barrel 32, the insulation barrel 32 is not enlarged by the anticorrosive 50.

Figure 7:
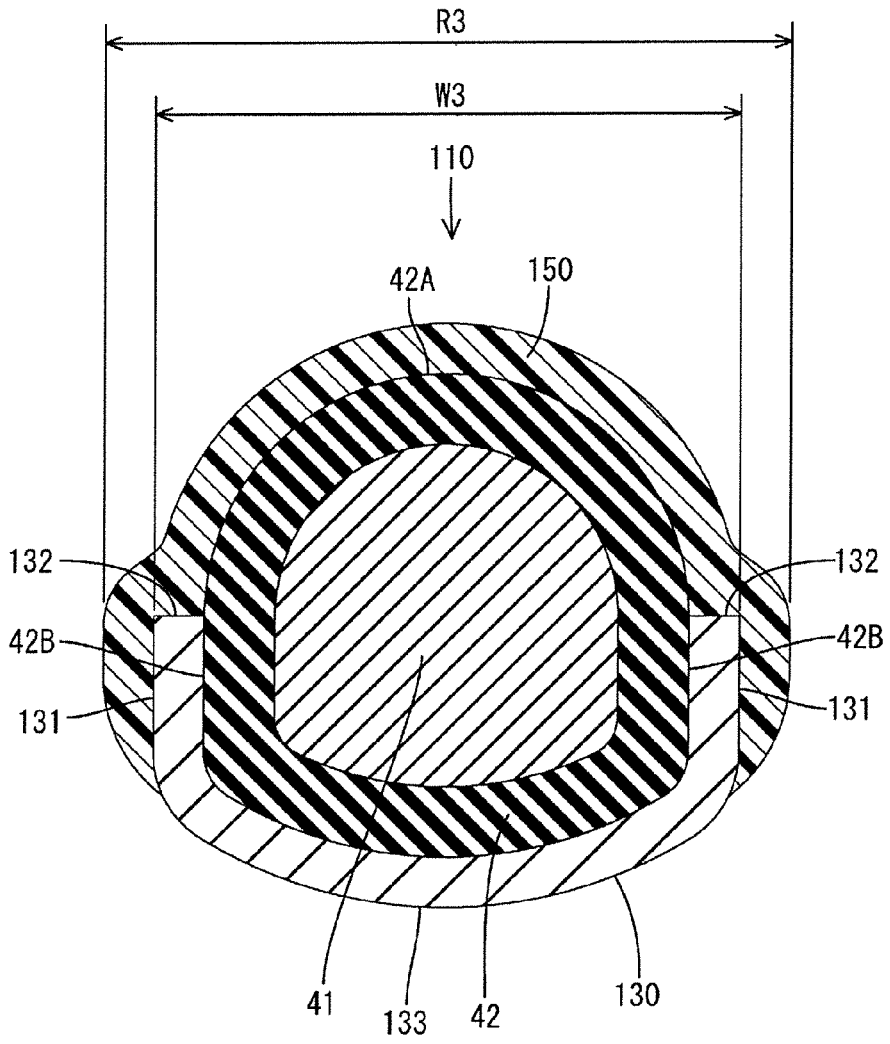
FIG. 7 is a section, corresponding to FIG. 6, of a conventional aluminum wire with corrosion-resistant terminal.
Figure 8:
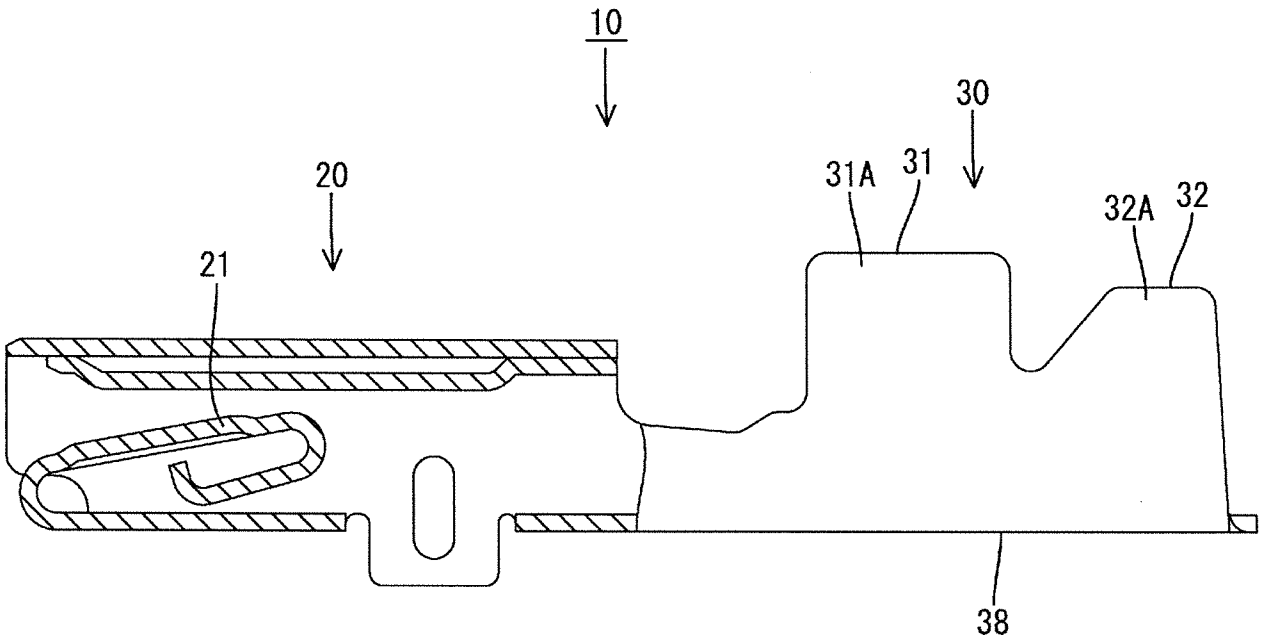
FIG. 8 is a side view partly in section of a corrosion-resistant terminal.

Here, effects of the corrosion-resistant terminal 10 of this embodiment are described in comparison to a conventional corrosion-resistant terminal 110 shown in FIG. 7. In the conventional corrosion-resistant terminal 110, a wire connecting portion 130 is provided with no storage portion for storing an anticorrosive 150. Specifically, tip parts 132 of barrel pieces 131 are arranged to face upward on opposite side parts 42B of a coating 42. Thus, the anticorrosive 150 dripped onto an upper part 42A of the coating 42 flows down along the upper part 42A of the coating 42 and reaches a bottom surface 133 beyond the tip parts 132 of the barrel pieces 131 arranged on the opposite side parts 42B of the coating 42. This causes the anticorrosive 150 to be applied in a region R3 wider than a maximum width region W3 on the upper surface of the wire connecting portion 130 and the wire connecting portion 130 is enlarged one size larger by the anticorrosive 150. Contrary to this, in the corrosion-resistant terminal 10 of this embodiment, the wire connecting portion 30 is not covered with the anticorrosive 50 over the entire circumference as shown in FIG. 6 (insulation barrel 32 is illustrated in FIG. 6) and the wire connecting portion 30 can be miniaturized in the lateral direction by an area where the anticorrosive 50 is absent.

Figure 9:
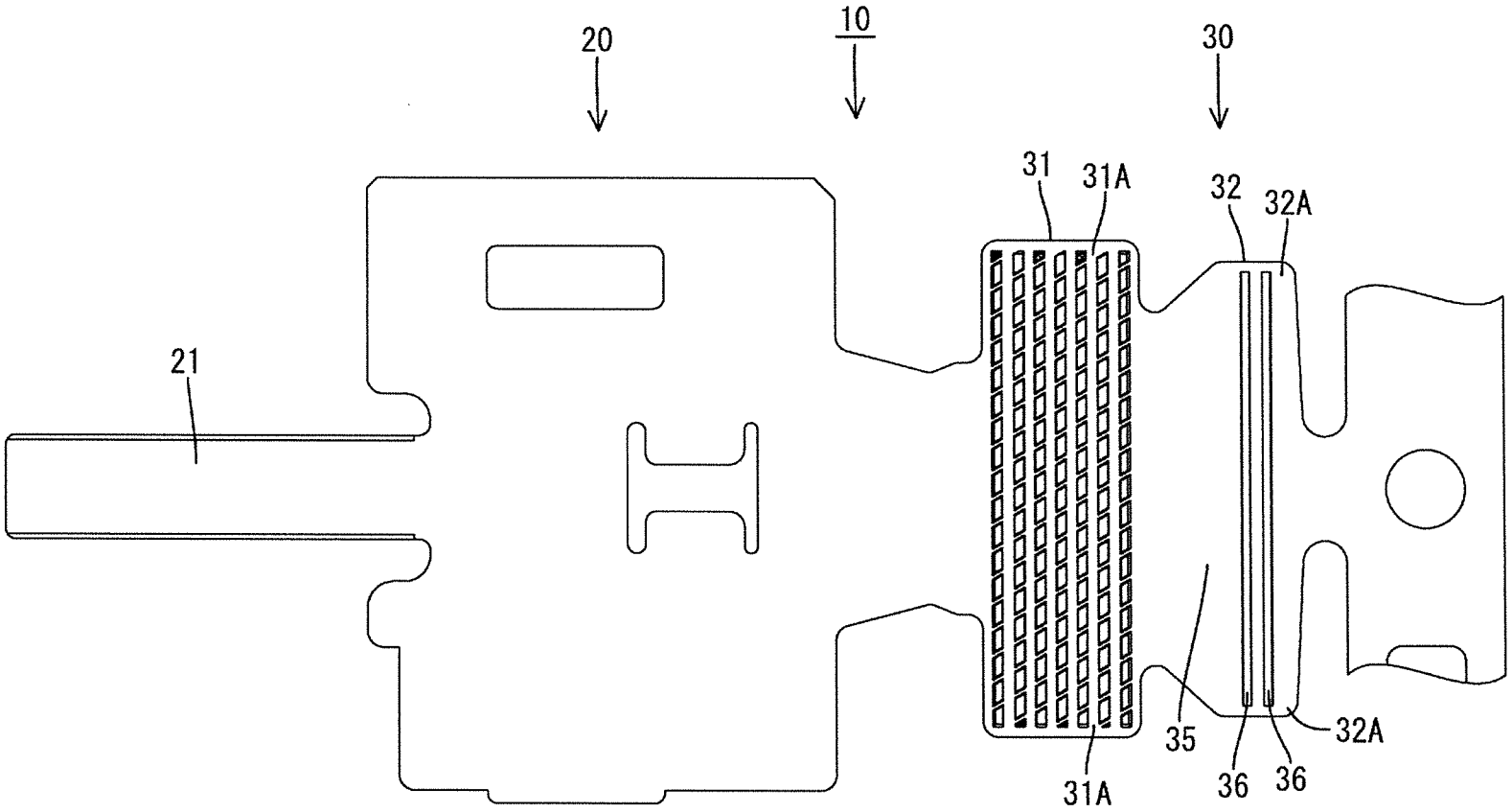
FIG. 9 is a development of the corrosion-resistant terminal.
Figure 11:
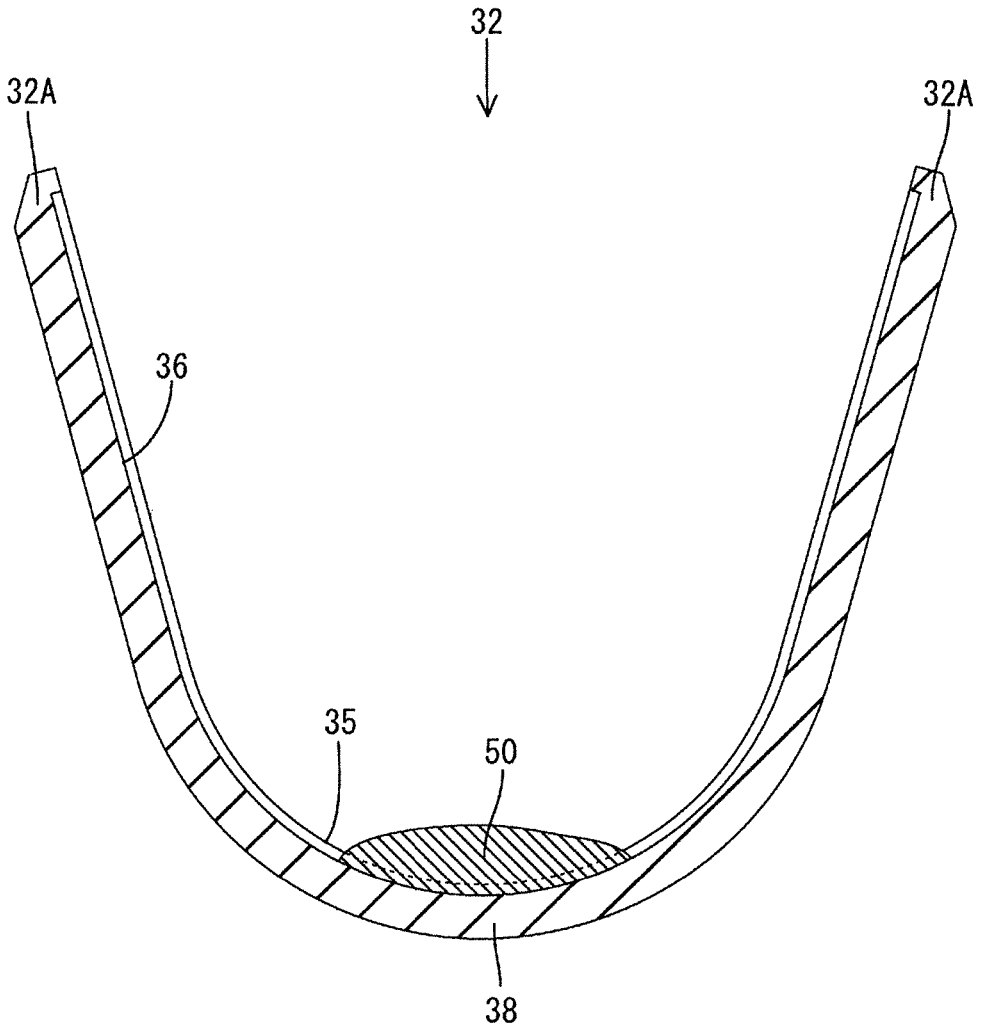
FIG. 11 is a section along E-E of FIG. 10.
Figure 12:
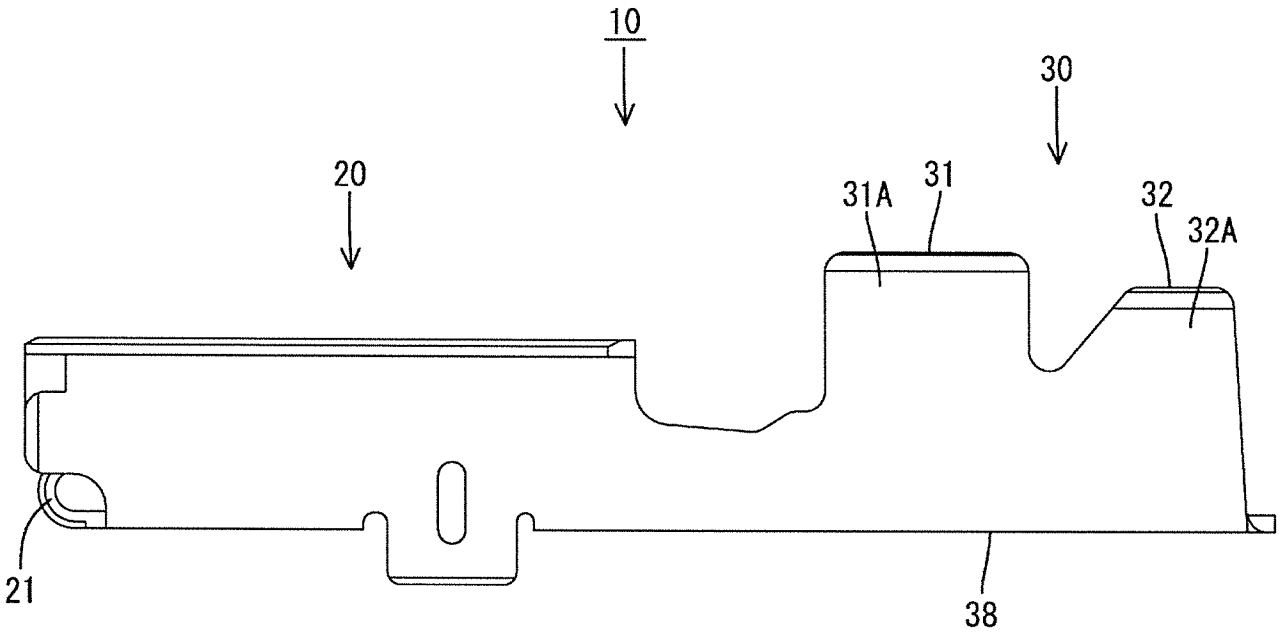
FIG. 12 is a side view of the corrosion-resistant terminal shown in FIG. 10.

Next, a serration structure of the insulation barrel 32 is described. As shown in FIG. 9, a plurality of anticorrosive penetration grooves 36 are formed on a crimping surface (forward facing surface shown in FIG. 9) of the insulation barrel 32. The anticorrosive penetration grooves 36 in a development state are formed to extend straight perpendicular to an axial direction of the aluminum wire 40. Thereafter, the insulation barrel 32 is formed into a substantially U shape by being bent and, associated with this, the anticorrosive penetration grooves 36 are also formed into a substantially U shape. As shown in FIG. 11, opposite end parts of the anticorrosive penetration groove 36 are closed without being open on the tip parts of the insulation barrel pieces 32A.

Figure 10:
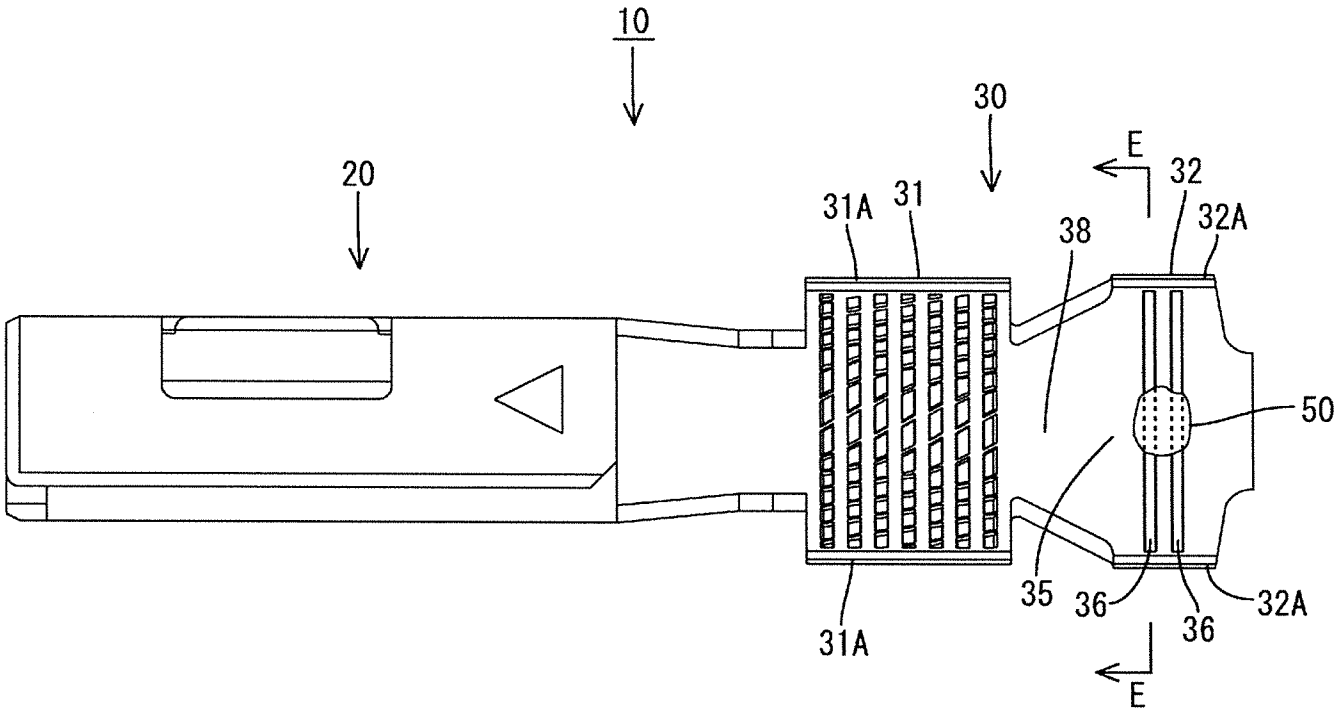
FIG. 10 is a plan view showing a state where an anticorrosive is dripped into anticorrosive penetration grooves on the bottom surface of an insulation barrel.
Figure 13:
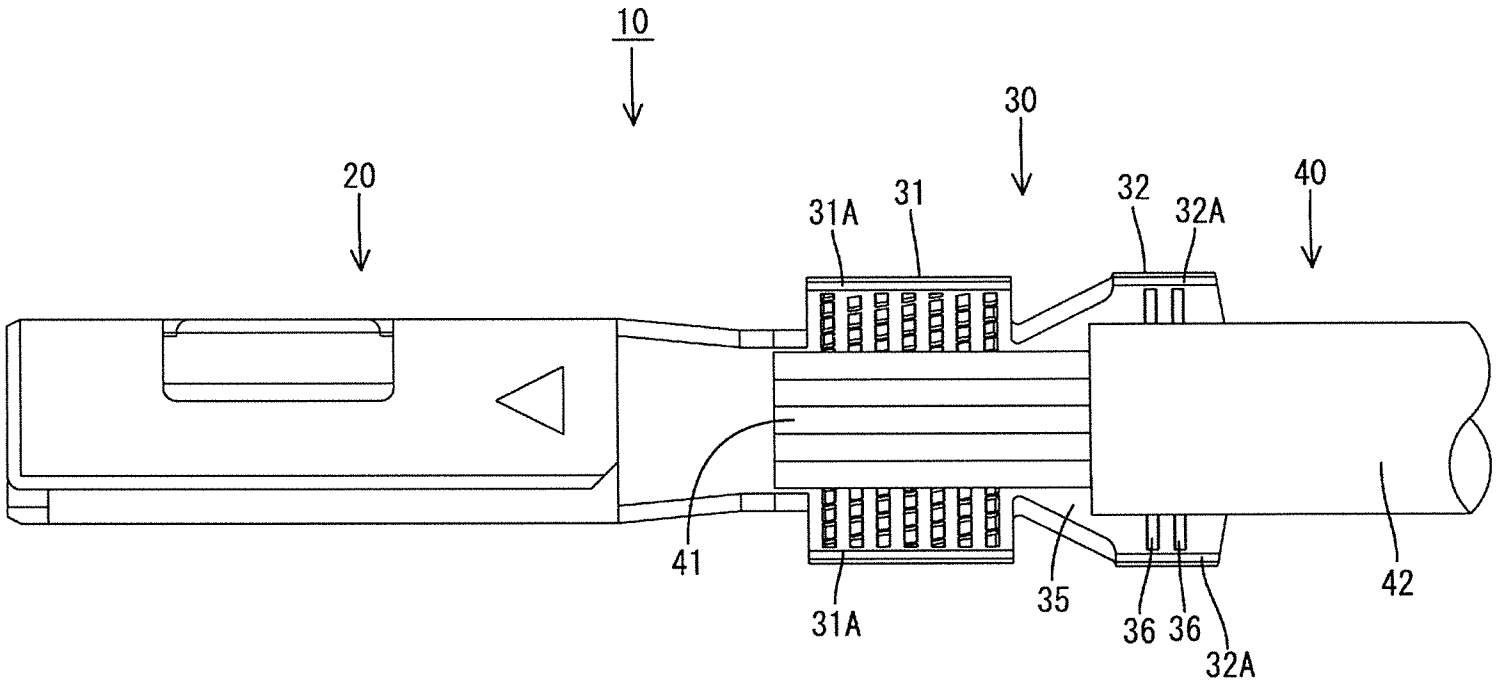
FIG. 13 is a plan view showing a state where an end of an aluminum wire is placed on a wire connecting portion of the corrosion-resistant terminal.
Figure 15:
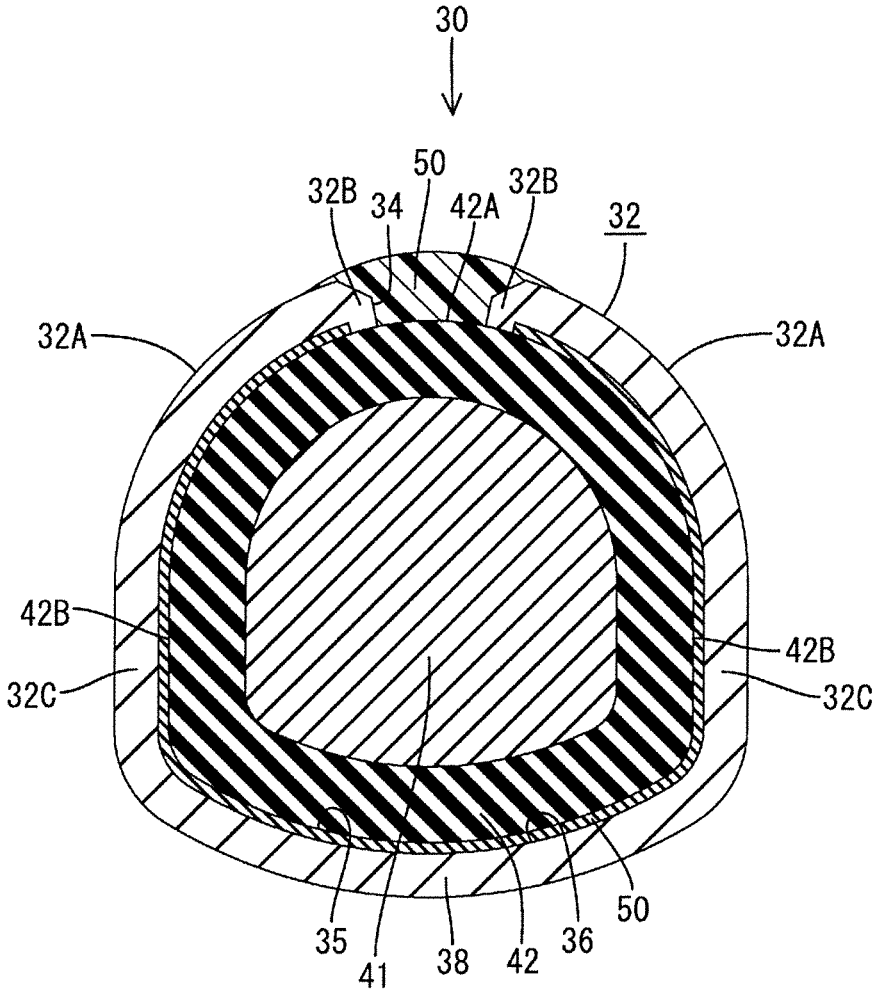
FIG. 15 is a section along F-F of FIG. 14 cut at the same position as in FIG. 11.

As shown in FIG. 10, the anticorrosive 50 is applied to the crimping surface 35 of the insulation barrel 32 in advance. This anticorrosive 50 is applied in a region of the crimping surface 35 including each anticorrosive penetration groove 36. Subsequently, when the coating 42 is placed on the crimping surface 35 of the insulation barrel 32 as shown in FIG. 13 and crimping is performed, the anticorrosive 50 pressed by the coating 42 moves along the anticorrosive penetration grooves 36 to spread in a circumferential direction. After crimping, the anticorrosive 50 is filled in the anticorrosive penetration grooves 36 as shown in FIG. 15. Thus, the anticorrosive 50 can be reliably present between the crimping surface 35 of the insulation barrel 32 and the coating 42 and the penetration of water to an interface of the core 41 and the wire barrel 31 through an interface of the crimping surface 35 of the insulation barrel 32 and the coating 42 from behind the insulation barrel 32 can be prevented, with the result that electrolytic corrosion can be prevented.

Next, functions of this embodiment configured as described above are described. To produce the aluminum wire with corrosion-resistant terminal 60, the anticorrosive 50 is first dripped onto the crimping surface 35 of the insulation barrel 32 to be partially applied as shown in FIG. 10 and UV irradiation is performed if necessary (pre-crimping applying step). As a result, the anticorrosive 50 is stored in the storage portions 33, 34 as shown in FIGS. 5 and 6 and arranged in the regions R1, R2 narrower than the maximum width regions W1, W2 on the upper surface of the wire connecting portion 30.

Subsequently, as shown in FIG. 13, the end of the aluminum wire 40 is placed on the wire connecting portion 30. At this time, the core 41 is arranged on the wire barrel 31 and the coating 42 is arranged on the insulation barrel 32. When the wire connecting portion 30 is crimped, the wire barrel 31 is crimped to the core 41 and the core 41 bites into knurling serration formed on a crimping surface of the wire barrel 31, whereby an oxide film on the surface of the core 41 is destroyed to establish an electrical conduction. Simultaneously with this, the insulation barrel 32 is crimped to the coating 42 and the anticorrosive 50 is filled into the anticorrosive penetration grooves 36 and applied to the entire crimping surface 35 (crimping step). Since this crimping is performed by a C-crimping method (such a crimping method that the tips of the respective insulation barrel pieces 32A do not overlap and a C-shaped cross-section is obtained), the respective insulation barrel pieces 32A and the coating 42 are held in close contact without any clearance. Further, since the anticorrosive 50 is present between the crimping surface 35 of the insulation barrel 32 and the coating 42, there is no possibility that water penetrates to the side of the core 41 along the surface of the coating 42 of the aluminum wire 40.

After crimping, the front and rear storage portions 33, 34 are formed as shown in FIG. 1. Subsequently, a necessary amount of the anticorrosive 50 is dripped and applied to the front and rear storage portions 33, 34 and UV irradiation is performed (post-crimping applying step). Then, as shown in FIG. 4, the anticorrosive 50 is cured while being retained on the upper surface of the wire connecting portion 30, wherefore the wire connecting portion 30 needs not become larger than the maximum width regions W1, W2 of the respective barrels 31, 32. Since each storage portion 33, 34 is formed by being surrounded by copper alloy exposed by punching out the base material obtained by applying tin plating to the surface of the raw material made of copper alloy, the anticorrosive 50 dripped into each storage portion 33, 34 inevitably comes into contact with the exposed copper alloy and exposure surfaces of the exposed copper alloy can be efficiently sealed with the anticorrosive 50. In other words, since the end parts of the copper alloy are concentrated on one position, the entire wire connecting portion 30 needs not be covered with the anticorrosive 50 and the application of the anticorrosive 50 can be suppressed to a minimum level.

As described above, in this embodiment, the anticorrosive 50 is applied to the surface (crimping surface 35) of the insulation barrel 32 to be held in contact with the coating 41. Thus, when crimping is performed, the anticorrosive 50 can be filled between the insulation barrel 32 and the coating 42 of the aluminum wire 40. Therefore, electrolytic corrosion can be prevented by reliably providing the anticorrosive 50 between the insulation barrel 32 and the aluminum wire 40.

The anticorrosive penetration grooves 36 extending in the direction intersecting with the axial direction of the aluminum wire 40 may be formed on the surface (crimping surface 35) of the insulation barrel 32 to be held in contact with the coating 41 and the anticorrosive 50 may be filled in the anticorrosive penetration grooves 36 in a state where the insulation barrel 32 is crimped to the coating 42. According to such a configuration, since the anticorrosive 50 is filled in the anticorrosive penetration grooves 36 in the crimped state, the anticorrosive 50 can be reliably provided between the insulation barrel 32 and the aluminum wire 40.

The insulation barrel 32 may include the bottom wall 38 and the pair of insulation barrel pieces 32A standing up from the opposite side edges of this bottom wall 38 and the anticorrosive penetration grooves 36 may be closed on the tip parts 32B of the pair of insulation barrel pieces 32A. According to such a configuration, the anticorrosive 50 can be applied substantially over the entire circumferential region of the insulation barrel 32. Further, since the anticorrosive penetration grooves 36 are not open on the tip parts 32B of the insulation barrel pieces 32A, there is no possibility that the anticorrosive 50 leaks out from the tips of the insulation barrel 32 as crimping is performed and the anticorrosive 50 can be retained between the insulation barrel 32 and the aluminum wire 40.

The anticorrosive 50 may move along the anticorrosive penetration grooves 36 and spread in the circumferential direction as crimping to the aluminum wire 40 is performed. According to such a configuration, the anticorrosive 50 needs not be applied to the entire surface (crimping surface 35) of the insulation barrel 32 to be held in contact with the coating 41. Since the anticorrosive 50 spreads in the circumferential direction through the anticorrosive penetration grooves 36 when crimping is performed, the anticorrosive 50 can be filled between the insulation barrel 32 and the coating 42 of the aluminum wire 40.

Further, the present invention may relate to the aluminum wire with corrosion-resistant terminal 60 which includes the above corrosion-resistant terminal 10 and the aluminum wire 40 connected to this corrosion-resistant terminal 10 and in which the anticorrosive 50 is further applied to the crimped insulation barrel 32 after the coating 42 of the aluminum wire 40 is placed on the insulation barrel 32 to be in contact with the anticorrosive 50 and crimping is performed.

Further, the present invention may relate to a method for producing the aluminum wire with corrosion-resistant terminal 60 including a pre-crimping applying step of applying the anticorrosive 50 in advance to the crimping surface 35 of the insulation barrel 32 of the corrosion-resistant terminal 10 including the wire barrel 31 and the insulation barrel 32, a crimping step of placing the coating 42 of the aluminum wire 40 on the insulation barrel 32 and performing crimping to fill the anticorrosive 50 between the coating 42 of the aluminum wire 40 and the insulation barrel 32, and a post-crimping applying step of further applying the anticorrosive 50 to the crimped insulation barrel 32.

The present invention is not limited to the above described and illustrated embodiment. For example, the following embodiments are also included in the technical scope of the present invention.

Although the female terminal including the terminal connecting portion 20 is illustrated as the corrosion-resistant terminal 10 in the above embodiment, the present invention may be applied to a male terminal including a tab-like connecting portion.

Although the UV curable anticorrosive 50 is used in the above embodiment, a thermosetting or thermoplastic anticorrosive may be used.

Although two anticorrosive penetration grooves 36 are formed on the crimping surface 35 of the insulation barrel 32 in the above embodiment, the number of the anticorrosive penetration groove(s) may be one, three or more according to the present invention. Alternatively, no anticorrosive penetration groove may be provided.

Although the anticorrosive penetration grooves 36 are closed on the tip parts 32B of the insulation barrel pieces 32A in the above embodiment, the anticorrosive penetration grooves may be open according to the present invention.

Although the coated wire including the core made of a plurality of metal strands is illustrated in the above embodiment, it may include, for example, a core formed of one metal strand having a relatively large diameter, i.e. a single-core coated wire.

Although the corrosion-resistant terminal 10 made of copper alloy is connected to the aluminum wire 40 in the above embodiment, other materials may be used provided that a core of a coated wire and a corrosion-resistant terminal to be connected to this core are formed of different types of metals. For example, copper with excellent strength may be used as a constituent material of the corrosion-resistant terminal.

LIST OF REFERENCE SIGNS

10 . . . corrosion-resistant terminal
30 . . . wire connecting portion
31 . . . wire barrel
32 . . . insulation barrel
32A . . . insulation barrel piece
32B . . . tip part
35 . . . crimping surface (surface of insulation barrel to be held in contact with coating)
36 . . . anticorrosive penetration groove
38 . . . bottom wall
40 . . . aluminum wire (coated wire)
41 . . . core
42 . . . coating
50 . . . anticorrosive
60 . . . aluminum wire with corrosion-resistant terminal

The invention claimed is:

1. A corrosion-resistant terminal before being crimped to a coated wire in which a core is covered with a coating, comprising:

a wire barrel to be crimped to the core exposed by removing the coating;

an insulation barrel to be crimped to the coating; and an anticorrosive applied in advance to a surface of the insulation barrel to be held in contact with the coating, wherein an anticorrosive penetration groove is formed on the surface of the insulation barrel to be held in contact with the coating and extends in a direction intersecting an axial direction of the coated wire, and the anticorrosive is filled in the anticorrosive penetration groove in a state where the insulation barrel is crimped to the coating.

2. The corrosion-resistant terminal of claim 1, wherein the insulation barrel includes a bottom wall and a pair of barrel pieces standing up from opposite side edges of the bottom wall, and the anticorrosive penetration groove is closed on tip parts of the barrel pieces.

3. The corrosion-resistant terminal of claim 2, wherein the anticorrosive moves along the anticorrosive penetration groove and spreads in a circumferential direction as crimping to the coated wire is performed.

4. A wire with corrosion-resistant terminal, comprising:

a coated wire with a core and a coating surrounding the core;

a corrosion-resistant terminal having a wire barrel crimped to the core exposed by removing the coating, an insulation barrel crimped to the coating; and an anticorrosive applied in advance to a surface of the insulation barrel to be held in contact with the coating and further applied to the crimped insulation barrel after crimping is performed, wherein an anticorrosive penetration groove is formed on the surface of the insulation barrel to be held in contact with the coating and extends in a direction intersecting an axial direction of the coated wire, and the anticorrosive is filled in the anticorrosive penetration groove in a state where the insulation barrel is crimped to the coating.

5. A method for producing a coated wire with corrosion-resistant terminal, comprising:

providing a corrosion-resistant terminal having a wire barrel and an insulation barrel, the insulation barrel having a crimping surface formed with an anticorrosive penetration groove extending in a direction intersecting an axial direction of the wire;

applying an anticorrosive in advance to the crimping surface of the insulation barrel of the corrosion-resistant terminal;

placing a coating of the coated wire on the crimping surface of the insulation barrel and performing crimping to fill the anticorrosive between the coating of the coated wire and the insulation barrel; and further applying the anticorrosive to the crimped insulation barrel.

6. The method of claim 5, wherein the crimping is carried out so that the anticorrosive moves along the anticorrosive penetration groove and spreads in a circumferential direction as crimping to the coated wire is performed.

7. The wire of claim 4, wherein the insulation barrel includes a bottom wall and a pair of barrel pieces standing up from opposite side edges of the bottom wall, and the anticorrosive penetration groove is closed on tip parts of the barrel pieces.

* * * * *